United States Patent [19]

Cornell

[11] Patent Number: 4,706,731

[45] Date of Patent: Nov. 17, 1987

[54] APPARATUS FOR MOLDING METALLIC ARTICLES

[75] Inventor: Robert Cornell, Cambridge, Ohio

[73] Assignee: 31, Inc., Newcomerstown, Ohio

[21] Appl. No.: 822,319

[22] Filed: Jan. 27, 1986

[51] Int. Cl.[4] ..... B22D 17/04; B22D 19/00

[52] U.S. Cl. ..... 164/317; 164/312; 164/332; 164/342; 164/112; 425/563

[58] Field of Search ..... 164/112, 113, 133, 136, 164/137, 152, 153, 332, 333, 334, 337, 339, 341, 342, 343, 312–318; 425/152, 563, 565

[56] References Cited

U.S. PATENT DOCUMENTS

| | | | |
|---|---|---|---|
| 3,137,045 | 6/1964 | Sunday | 164/332 |
| 3,916,986 | 11/1975 | Boberg | 164/332 |
| 3,985,180 | 10/1976 | Boberg | 164/332 |

FOREIGN PATENT DOCUMENTS

| | | | |
|---|---|---|---|
| 0618187 | 8/1978 | U.S.S.R. | 164/312 |

*Primary Examiner*—Nicholas P. Godici
*Assistant Examiner*—Richard K. Seidel
*Attorney, Agent, or Firm*—Renner, Kenner, Greive, Bobak & Taylor

[57] ABSTRACT

An apparatus (10) for molding metallic articles such as wheel weights (11). Opposed mold sections (108, 109) are carried on support plates (41, 42) that are movable within a stanchion (40) by virtue of an actuating means (45). A feed mechanism (115) delivers mounting clips (18) to one of the mold sections (109), and an escapement means (135) assures that only one clip (18) is delivered at a time. The actuating mechanism (45) sequentially closes the mold sections (108, 109) to form a cavity (100) therebetween, moves the closed mold sections (108, 109) into engagement with an injection tube (79) which mates with a sprue hole (111). The injection tube (79) also presents a positioning lug (180) accurately to rotate the clip (18) to its desired disposition. The injection tube displaces a plunger piston (70) in response to continued movement of the mold sections against the injection tube (79) by the actuating means (45) to pump molten metal (74) from a reservoir (75) through the injection tube (79) and into the mold cavity (100). The actuating means (45) cyclically open the mold sections (108, 109) so that an ejection means (184) on the same barrel (122) that presents the annular shoulder (121) which served as a stop to locate the clip (18) along the lower mold section (109) when it arrived from the feed mechanism (115) can remove any sprue and eject the wheel weight (11) from the mold section (109) and out through a funnel hopper (165).

17 Claims, 7 Drawing Figures

APPARATUS FOR MOLDING METALLIC ARTICLES

TECHNICAL FIELD

The present invention relates to apparatus for molding metallic items. More particularly, the present invention relates to a new and novel apparatus for cyclically moving mold sections whereby to open and close the mold cavity formed therebetween and to inject molten metal into the cavity of a closed mold at an appropriate time during said cycle. Specifically, the present invention relates to such molding apparatus wherein a mounting clip is automatically fed to the cavity, and positioning means are provided accurately to dispose the mounting clip in the most effective disposition with respect to the cavity within which the article is to be molded. As such, the present invention is particularly suited to the manufacture of weights for tire rims, although once the concept is understood it can be readily adapted to the manufacture of other molded articles.

BACKGROUND ART

The molding of metallic articles is a historic manufacturing technique, with single and multiple cavity molds being quite common. Moreover, the art abounds with automatic molding apparatus.

When the entire article is made of a single type of metal it appears that little can be done to improve the historic technique. However, when the finished article comprises two distinct metallic components, and particularly when it is desired that one component physically embrace at least a portion of the second component, the complexity of the manufacturing process is significantly increased.

Excellent insight as to the difficulties attendant upon the manufacture of such items can be obtained by reference to the procedure by which simple tire weights are fabricated.

The entire weight normally comprises a lead body portion and a steel mounting clip. The lead of the body portion embraces at least a portion of the mounting clip, and as such, the lead is generally cast about a portion of the mounting clip which must be painstakingly oriented in order not only to effect the desired mechanical bonding therebetween but also to assure that the steel clip will not cause the lead to rupture during use, or even as the weight is being mounted. As such, the manufacture of such wheel weights has, heretofore of necessity, been rather labor intensive.

It is, therefore, a primary object of the present invention to provide an apparatus for molding metallic articles wherein an object to be encapsulated, in whole or in part, within the cast metal is accurately positioned within the mold by virtue of the unique molding apparatus and without painstakingly intricate manual manipulation.

It is another object of the present invention to provide an apparatus for molding metallic articles, as above, wherein the molten metal is injected directly into the cavity at the minimal pressure required, thereby eliminating not only feed runs but also virtually eliminating any flash.

It is a further object of the present invention to provide an apparatus for molding metallic articles, as above, wherein the mold closing mechanism sequentially effects injection of the molten metal, thus assuring the safety feature that the molten metal is not injected unless the mold is closed.

It is yet another object of the present invention to provide an apparatus for molding metallic articles, as above, wherein an application that would normally be expected to require a three-part mold—the third part being required to move generally transversely the direction in which the other two parts move—can be accomplished by a relatively uncomplicated two-part mold.

It is a still further object of the present invention to provide an apparatus for molding metallic articles, as above, which is readily adaptable for the production of wheel weights and wherein positioning means is employed rotatably to orient the mounting clip with respect to the mold cavity in order to maximize the mechanical bonding between the mounting clip and that portion of the weight that is being molded.

These and other objects of the invention, as well as the advantages thereof over existing and prior art forms, which will be apparent in view of the following specification are accomplished by means hereinafter described and claimed.

In general, an apparatus for molding metallic objects which embodies the concept of the present invention is particularly adapted for use in the manufacture of wheel weights.

A stanchion is secured to the frame of the apparatus, and first and second support plates are disposed within the stanchion for movement along the longitudinal axis of the stanchion. First and second mold sections are carried, respectively, on the first and second support plates.

An activating means is mounted on the stanchion to effect movement of the first support plate toward and away from the second support plate. Movement of the first support plate toward the second support plate effects a closure of the mold sections carried on the support plates. Movement of the first support plate away from the second plate effects an opening of the mold sections carried on the support plates.

A pump means is also carried by the stanchion, and an injection tube extends outwardly from the pump means and is disposed in generally parallel relation to the longitudinal axis of the stanchion. The injection tube cooperates with a sprue opening through the second mold section such that continued movement of the first support plate in the direction which effects closure of the mold sections also moves the second support plate to bring the second mold section into engagement with the injection tube and axially translates the injection tube to actuate the pump means whereby to inject molten metal into the cavity of the closed mold.

When the subject apparatus is employed to make wheel weights a rail is provided sequentially to feed individual mounting clips to the mold. For convenience, each clip may be gravity fed to the lowermost, or second, mold section. The rim of the second mold section provides, in effect, an extension of the rail means whereby the clip can continue along the rim of the second mold section until it engages appropriate stop means. So positioned, a positioning lug associated with the injection tube rotates the clip to effect the desired orientation with respect to the mold cavity prior to, or simultaneously with, injection of molten metal into the cavity.

One preferred embodiment of apparatus for molding metallic apparatus according to the concept of the present invention is shown by way of example in the accompanying drawings without attempting to show all of the various forms and modifications in which the invention might be embodied; the invention being measured by the appended claims and not by the details of the specification.

EXEMPLARY EMBODIMENT FOR CARRYING OUT THE INVENTION

Figure 6:
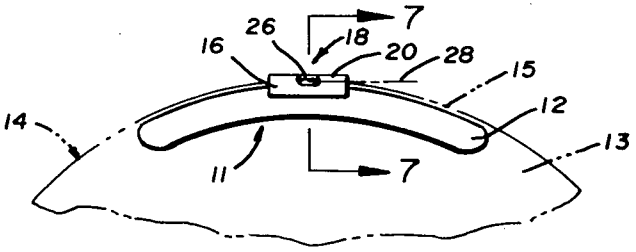
FIG. 6 is a side elevation of a wheel weight of the type manufactured on apparatus embodying the concept of the present invention, said wheel weight depicted as it is mounted on a wheel rim and being incorporated on the same sheet of drawings as FIG. 2; and, FIG. 7 is a cross section taken substantially along line 7—7 of FIG. 6 further depicting the interrelation of the steel mounting clip with respect to the molded body portion thereof, said figure also being incorporated on the same sheet of drawings as FIG. 2.

Apparatus which embodies the concept of the present invention for molding metallic articles is designated generally by the numeral 10 on the accompanying drawings. An article which typifies that which can successfully be made on apparatus 10 would be the wheel weight 11 depicted in FIGS. 6 and 7.

Figure 7:
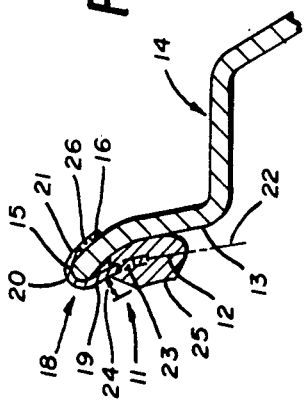

Wheel weight 11 has a molded, generally lead, body portion 12 of arcuate configuration to permit it to be nestled in conforming juxtaposition against the outer wall 13 of a wheel rim 14, adjacent the lip 15 thereof. The first arm 16 of a mounting clip 18 hooks over the lip 15 of the wheel rim 14 and is squeezed thereagainst lockingly to embrace the wheel rim 14 between the arm 16 and the body portion 12 of the wheel weight 11. As best seen in FIG. 7 the mounting clip 18 has a second arm 19 that is disposed within the body portion 12.

The arms 16 and 19 join at vertex 20. Generally, the first arm 16 may be conveniently made to be shorter than the second arm 19, but in any event arm 16 is to be of sufficient length securely to embrace the wheel rim 14. To facilitate mounting of the weight 11 onto the rim 14 the first arm 16 preferably curves arcuately outwardly from the vertex 20, the convex surface 21 of the first arm 16 facing away from the second arm 19.

The second, generally longer, arm 19 may extend straight outwardly from the vertex 20, but if other than straight it may curve away from the first arm to facilitate locating the second arm 19 as close to the central, radial plane 22 of the weight as possible.

Means should be provided in conjunction with the second arm to effect a mechanical bond between the body portion 12 of the weight 11 and the clip 18. The arm 19 may, for example, be corrugated or otherwise disfigured, but experience has shown that the provision of an aperture 23 in the medial portion of the arm 19 is sufficient to serve as a means to increase the mechanical bonding between the body portion 12 and the mounting clip 18. When the body portion 12 is molded the molten metal will flow through the aperture 23 of arm 19, which extends within the mold cavity, and thereby provide an effective integration of the body portion 12 to the mounting clip 18. The effectiveness of this bond, however, can be seriously jeopardized if the thickness 24 of the metal forming the body portion 12 between the embedded arm 19 of the clip 18 and the outer wall 25 of the body portion 12 is of insufficient dimension to preclude the metal clip 18 from rupturing the body portion 12 during use, or even as the weight 11 is being mounted to the rim 14. As will hereinafter become apparent, the apparatus 10 is provided with means to assure that the second arm 19 is disposed, as desired, with respect to the cavity of the mold within which the body portion 12 of the weight 11 is formed.

An aperture 26 may also be provided in the medial portion of the arm 16. The aperture 26 is provided to facilitate bending that arm, as necessary lockingly to embrace the wheel rim 14. As such, the aperture 26 may be elongated with the major axis 28 being disposed parallel to the vertex 20. In addition to facilitating the bending of the arm 16 by employing an elongated aperture 26 the use of different configurations for apertures 23 and 26 permits a ready, visual determination as to whether the proper arm of the clip 18 has been encapsulated within the body portion 12 of the wheel weight 11.

The historic means for making wheel weights 11 required that the clips 18 be manually positioned with painstaking care within the cavity of the mold. As will become apparent from the following detailed description of the apparatus 10 the deficiencies of the prior art means for molding metallic articles are abrogated by apparatus 10.

Figure 1:
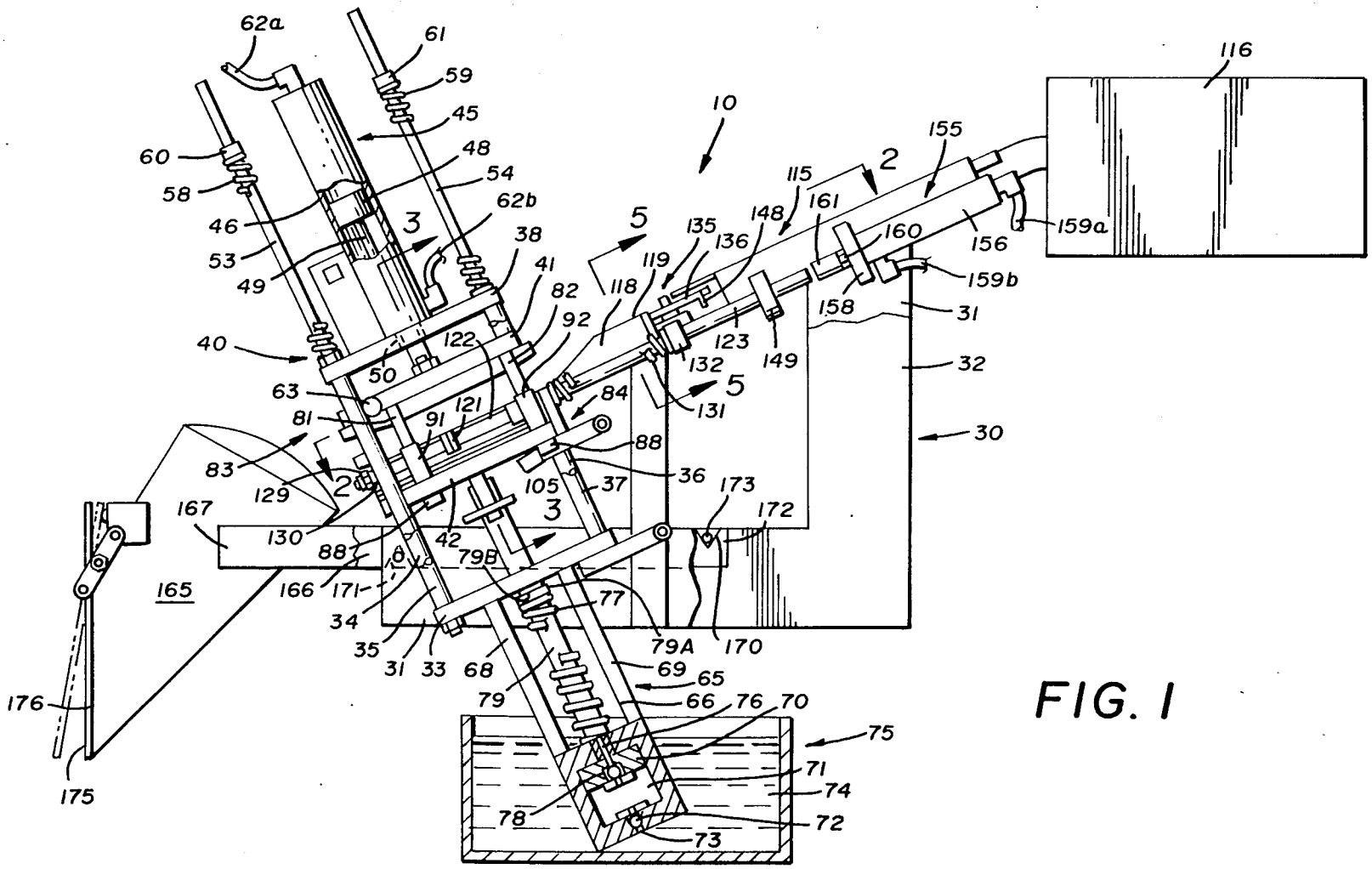
FIG. 1 is a side elevation, in part schematic, depicting a metal molding apparatus embodying the concept of the present invention.

With reference to FIG. 1 the apparatus 10 is generally supported by a frame 30. The frame 30 employs a pair of laterally spaced side plates 31 and 32 which can be mounted where desired. A base plate 33 is fixed transversely between the side plates 31 and 32, and four posts 34, 35, 36 and 37 are secured to, and extend perpendicularly upwardly from, the base plate 33. A cap plate 38 is secured to the upper ends of the posts 34–37. The rigid arrangement of the posts 34–37, the base plate 33 and the cap plate 38 comprise a stanchion 40 within which the molding apparatus operates. Specifically, first and second plates 41 and 42 are movably mounted within the stanchion 40.

An actuating means 45 is supported from the stanchion 40. The actuating means conveniently comprises a double acting cylinder 46 that is secured to, and extends upwardly from, the cap plate 38. A piston 48 is movably mounted within the cylinder 46 and presents a piston rod 49 that passes downwardly through an aperture 50 in the central portion of the cap plate 38. The outermost end 51 of the piston rod 49 is secured to the central portion of the first, or uppermost, support plate 41.

A pair of guide pins 53 and 54 are also secured to the first support plate 41, and they extend upwardly through appropriate apertures (not shown) in the cap plate 38. A helical compression spring 58 circumscribes the guide pin 53, and a similar compression spring 59 circumscribes guide pin 54 to interact between the cap plate 38 and the stop nuts 60 and 61 on the respective guide pins 53 and 54 to bias the first support plate 41 upwardly within the stanchion 40.

Hydraulic lines 62*a* and 62*b* communicate with the cylinder 46 selectively to effect extension and retraction of the piston rod 49. Extension of the piston rod 49 outwardly of the cylinder 46 moves the first support plate 41 toward the second support plate 42 for the purposes hereinafter more fully described. In order to assure that the first support plate 41 can move with unimpaired freedom within the stanchion 40, a pair of wheels 63 and 64 may be rotatably mounted from the first support plate 41 for rolling engagement with the posts 34 and 35.

A pump means 65 is secured beneath the base plate 33. The pump housing 66 is suspended in spaced relation beneath the base plate 33 by a pair of laterally spaced mounting legs 68 and 69 that extend upwardly from the housing 66 to be secured to the base plate 33. A displacement piston 70 is movable axially within the cylindrical bore 71 formed interiorly of the pump housing 66. A first check valve 72 is mounted within the inlet port 73 of the housing 66 and is operative to permit molten metal 74 to flow from a reservoir 75 of the molten metal 74 exteriorly of the housing 66 through the inlet port 73 and into the bore 71 when the piston 70 moves upwardly, and conversely to preclude existing flow of the molten metal from the bore 71 outwardly through the inlet port 73 when the piston 70 moves downwardly, as those directions are referenced from the orientation of FIG. 1.

An exhaust port 76 communicates with the bore 71 through the piston 70, and a second check valve 78 is included within the exhaust port 76 to permit the flow of molten metal 74 outwardly through the exhaust port 76 in response to downward movement of the piston 70 but to preclude reverse flow through the exhaust port 76 when the piston 70 moves upwardly. The exhaust port 76 extends axially of the injection tube 79 secured to the piston 70. The injection tube 79 supplies the metal to be molded, as hereinafter more fully explained, and a compression spring 77 encircles the injection tube 79 to act between the housing 66 and a lock ring 79A secured to the injection tube 79 to be fixed axially with respect thereto. The lock ring 79A may, for example, be received within an annular recess 79B that circumscribes the outer surface of the injection tube 79. The action of the spring 77 thus continuously biases the injection tube 79 axially upwardly, with engagement of the piston 70 against the housing 66 effecting a limit to the axial extension of the injection tube 79 produced by the biasing action of spring 77.

Figure 2:
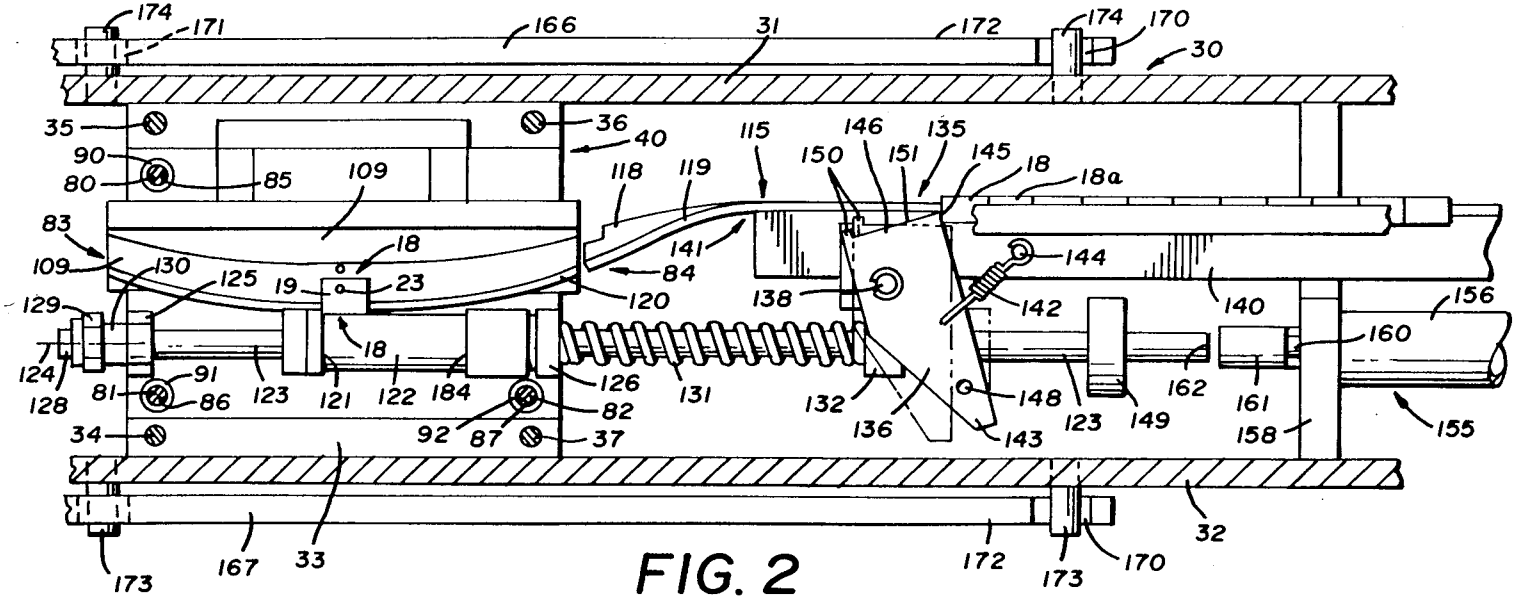
FIG. 2 is a section taken substantially along line 2—2 of FIG. 1 depicting the mounting clip feed slide and the lower mold section cooperating therewith, in top plan.

The second support plate 42 is interposed, within the stanchion 40, between the first support plate 41 and the injection tube 79 and is operatively interconnected to both. Specifically, three leg members 80, 81 and 82 (FIGS. 1 & 2) are rigidly secured to, and depend downwardly from, the first support plate 41. Legs 80 and 81 are disposed in proximity to the two corners of the rectilinear, first support plate 41 which define what may be deemed to be the discharge side 83 of the stanchion 40, and leg 82 is disposed in proximity to one corner of the rectilinear, first support plate 41 at what may be deemed to be the feed side 84 of the stanchion 40. For reference, the discharge side 83 refers to that side of the stanchion 40 from which a molded weight 11 emanates, and the feed side 84 refers to that side of the stanchion 40 into which the mounting clips 18 are fed to the mold means, as hereinafter more fully described. As best depicted in FIG. 2, each leg 80–82 is slidably received through a corresponding aperture 85, 86 and 87, one being located in proximity to the corresponding corner of the second, or lowermost, support plate 42. The leg members 80–82 carry the second support plate 42, and each leg member is provided with a radially enlarged head 88 (FIGS. 1, 3 and 4) to engage the underside 89 of the second support plate 42 and retain the support plate 42 on the leg members 80–82.

In addition, barrel bushings 90, 91 and 92 are secured to the second support plate 42, each being affixed in registry with a corresponding aperture 85, 86 and 87. The barrel bushings 90–92 slidably engage the respective legs 80–82 to provide a greater purchase by which to stabilize the second plate 42 as well as to maintain the orientation thereof in parallel disposition with respect to the first plate 41 during their relative movement, as hereinafter more fully described.

A multifunctional linking mechanism 100 is also interconnected between the second support plate 42 and the injection tube 79. A pair of leg members 101 and 102 are rigidly secured to, and extend downwardly from, the second support plate 42. The leg members 101 and 102, in turn, slidably engage appropriate apertures 103 and 104 which pierce the guide plate 105 attached in proximity to the nozzle 106 on the injection tube 79. The interaction of the leg members 101 and 102 with the guide plate 105 provides some secondary support to the second support plate 42, but the primary function of mechanism 100 is not only to assure the necessary alignment of the injection tube 79 with the second support plate 42 for the hereinafter described injection of molten metal but also to assist in opening the mold sections, as hereinafter more fully explained.

Figure 3:
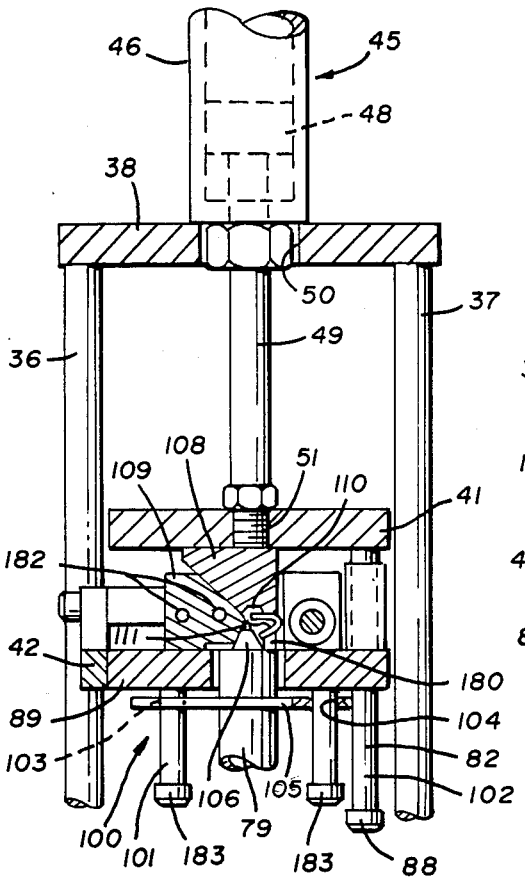
FIG. 3 is a section taken substantially along line 3—3 of FIG. 1 depicting the opposed mold halves closed, the supports for said mold halves and related mechanism in substantially vertical cross section.

A first mold section 108 is secured to the first support plate 41 in opposition to a mating second mold section 109 secured to the second support plate 42. The mold sections 108 and 109, when matingly engaged as depicted in FIG. 3, define a mold cavity 110 therebetween. A sprue hole 111 is provided through the second mold section 109, and the conically shaped sprue hole 111 is matingly engaged by the conically shaped outer surface 112 of the nozzle 106 to effect injection of the molten metal, again, as hereinafter more fully described.

Figure 5:
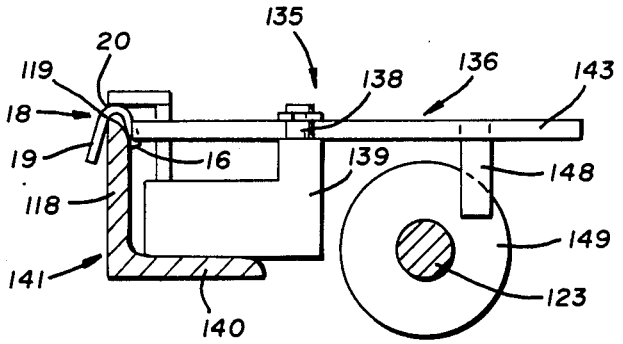
FIG. 5 is a section taken substantially along line 5—5 of FIG. 1 and depicting the mounting clip feed slide mechanism in cross section.

A feed mechanism 115 (FIGS. 1 & 2) supplies mounting clips 18 at the appropriate time in the molding cycle. A vibrating hopper 116, of the type commercially available, can be adapted to orient the mounting clips with the vertex 20 facing upwardly and with the two legs 16 and 19 properly disposed for delivery to the mold. Specifically, the hopper 116 delivers each clip 18 to the transport rail 118 of the feed mechanism 115 with the first arm 16 disposed to the right of the rail 118 as viewed in FIG. 5 and with the second arm 19 disposed to the left of the rail. The vertex 20 of the clip slidably engages the ridge 119 of the rail 118. The rail may preferably be disposed to permit a gravity feed. That is, the rail 118 leads tangentially outwardly from the hopper 116 and downwardly such that the ridge 119 of the rail 118 terminates in close proximity to, and in alignment with, the rim 120 of the second, or lower, mold section 109. In effect, the rim 120 provides an extension of the rail 118 whereby a clip 18 can continue to slide therealong until it reaches an appropriate stop means.

The stop means may well comprise an annular shoulder 121 which extends radially outwardly of the cylindrical barrel 122. The barrel 122 is affixed to a mounting shaft 123 that extends along the longitudinal axis 124 of the barrel 122. The mounting shaft 123 is, in turn, received within a pair of spaced pillars 125 and 126 that are secured to, and extend upwardly from, the second, or lower support plate 42. Each pillar may be provided with an appropriate bearing, not shown, to permit the shaft 123 axially to reciprocate within the pillars 125 and 126. The barrel 122, which is affixed to the shaft 123 between the pillars 125 and 126, thus reciprocates with the shaft 123.

The pillar 125 is located in proximity to the discharge side 83 of the stanchion 40, and the end of the shaft 123 which extends beyond the pillar 125 is threaded, as at 128, to receive an adjusting nut 129. A first collar 130 is carried on the shaft 123 between the adjusting nut 129 and pillar 125 to prevent the threads 128 from degrading the bearing surface within the pillar 125 along which the shaft reciprocates.

The pillar 126 is located in proximity to the feed side 84 of the stanchion 40, and that portion of the shaft 123 which extends outwardly beyond the pillar 126 carries a helical compression spring 131. The spring 131, which preferably circumscribes the shaft 123, extends between the pillar 126 and a second collar 132 that may be carried on, and be secured to, the shaft 123 at a location therealong appropriate to the length, and strength, of the spring 131. As such, the action of the spring 131 between the pillar 126 and second collar 132 biases the shaft 123 such that the first collar 130 abuts the pillar 125. Hence, by selectively positioning the adjusting nut 129 one can accurately control the location assumed by the shoulder 121 on the barrel 122 so that a clip 18 sliding along the rim 120 of the lower mold section 109 will be precisely located, where desired, therealong by engagement of the arm 16 on the mounting clip 18 with the stop means 121.

In order to assure that only one clip 18 at a time will be delivered to the mold, an escapement means 135 is provided which cooperates with the clips 18 carried on the transport rail 118 and which, for convenience, may be actuated by reciprocation of the shaft 123.

Specifically, the escapement means 135 may employ a bell crank 136 that is mounted for rocking movement in a plane oriented transversely that of the rail 118. A support pin 138 (FIG. 5) extends upwardly from a support block 139 carried on the mounting flange 140 of an angle iron 141, the other flange of which serves as the rail 118. The bell crank 136 is carried on the pin 138, and a coiled tension spring 142 acts between the first arm 143 of the bell crank 136 and an anchor pin 144 which may be secured to the mounting flange 140 of the angle iron 141. The biasing action of the spring 142 causes the bell crank 136 to swing about the axis of the support pin 138 and thereby forces the first pawl corner 145 on the second arm 146 of the bell crank 136 into engagement with the side of the rail 118. The relative disposition of the rail 118 and the bell crank 136 is such that engagement of the pawl corner 145 with the rail 118 precludes passage of the clips 18 past the pawl corner 145.

A trip stud 148 extends downwardly from the outer end portion of the first arm 143 of the bell crank 136 for engagement by an actuating hub 149 affixed to the mounting shaft 123. When the shaft reciprocates against the biasing action of the compression spring 131 the hub 149 engages the stud 148 and rocks the bell crank 136 against the biasing action of spring 142 to move the second pawl, in the form of a stud 150, against the rail 118. This movement of the bell crank 136 releases the mounting clip held by the pawl corner 145 and allows the clip 18 to slide along the rail 118 until it engages the pawl stud 150. This freedom of movement which allows the clip 18 to slide along the rail 118 until it engages the pawl stud 150 is assured by having the stud 150 extend outwardly beyond the surface 151 that defines the outer end of the second arm 146.

When the spring 131 is freed to effect retroreciprocation of the shaft 123, the spring 142 swings the bell crank 136 to move the pawl stud 150 away from the rail 118 and to drive the pawl corner 145 toward the rail 118. This releases the clip 18 held by the pawl stud 150, but retains the next successive clip 18*a*.

The drawings depict the pawl corner 145 in direct contact with the rail 118 to retain a clip 18, but it has been found that the apparatus 10 works equally well if the spring 142 is of sufficient strength to grip the leg 16 of the clip 18 between the pawl corner 145 and the rail 118 itself. Thus, while it is desirable that the axial span between the pawl corner 145 and the pawl stud 150 be approximately equal to the length of the clip 18 in order to allow the engagement of the pawl corner 145 with the rail 118, as depicted, by not requiring this dimensional conformity, one escapement means 135 may be employed in conjunction with clips 18 of various dimensions.

As should have heretofore become apparent, movement of the mounting shaft 123 can be effected in one direction by judicious selection of the spring 131 in conformity with the dimensional span between the second collar 132 and the pillar 126. Movement of the shaft 123 in the opposite direction is effected by drive means 155.

The drive means 155 comprises a double-acting cylinder 156 carried on the mounting block 158 that extends between the side plates 31 and 32 of the frame 30. Tubing 159*a* and 159*b* communicates with the interior of the cylinder 156 selectively to extend or retract the piston rod 160. The piston rod 160 terminates in a head 161 that is aligned with, and engages, the opposed end 162 of the mounting shaft 123 when those elements are aligned as depicted in FIG. 1.

For convenience, and safety, one may attach a funnel hopper 165 to the discharge side 83 of the stanchion 40. Demountably to secure the funnel hopper 165 to the frame 30 of apparatus 10, and thereby facilitate maintenance access to the discharge side 83 of stanchion 40, a pair of mounting plates 166 and 167 may be secured to, with one on each side of, the funnel hopper 165. The mounting plates 166 and 167 may each be provided with at least one upwardly directed notch 170 and at least one downwardly directed notch 171. By positioning the upwardly directed notch 170 in proximity to the distal ends 172 of the mounting plates 166 and 167, and by placing the downwardly directed notch 171 along the medial extent of each mounting plate 166 and 167 to coact, respectively, with mounting pins 173 and 174 which extend transversely outwardly from the side plates 31 and 32, the funnel hopper 165 may be quickly and easily mounted and demounted.

A gate 175 is mounted to open and close the discharge mouth 176 of the funnel hopper 165. In that way the discharge of the weight 11 through the funnel hopper will open the gate 175, and the weight of the gate 175 itself will effect closure.

Operation

Standard heater means, not shown, are employed to maintain molten metal 74 within the reservoir 75. For the manufacture of wheel weights 11 this metal would likely be lead. Once the metal, and the passages through which it is to flow, are brought to an appropriate temperature, the drive means 155 is actuated to trip the escapement means 135 and thereby free a mounting clip 18 to slide down the rail 118 and along the rim 120 of the second, or lower, mold section 109 until the first arm 16 on the clip 18 engages the annular shoulder 121 of the barrel 122. With the adjusting nut 129 having been properly located before initiating operation of the apparatus 10, the shoulder 121 will define the precisely desired location of the clip 18 along the rim 120 of the lower mold section 109.

With the mounting clip 18 appropriately positioned to straddle the rim 120 of the lower mold section 109 the actuating means 45 operates to extend the piston rod 49 and move the first support plate 41 downwardly toward the second support plate 42. This movement eventually brings the two mold sections 108 and 109 into mating juxtaposition, and as they so engage the mold cavity 100 is closed. To effect a sealing closure between the mold section 108 and 109 either the rim 120 on mold section 109 or the opposed portion on mold section 108 must be recessed, as required, to receive the leg 19 of the clip 18 therethrough and yet permit the required closure along the remainder of the parting line between the mold sections, as is well known to the art.

Continued extension of the piston rod 49 after the mold sections close drives the second support plate 42 in spaced parallel disposition with respect to the first support plate 41. This movement brings the conically shaped sprue hole 111 into mating engagement with the conical outer surface 112 of the nozzle 106 and at the same time brings the positioning lug 180 into engagement with the first arm 16 of the mounting clip disposed along the rim 120 of the lower mold section 109. The lug 180 is presented from the end of the injection tube 79 but is radially offset from the nozzle 106. As such, when the lug 180 engages the clip 18 it rotates the clip 18 to effect the desired orientation of the arms 16 and 19. Perhaps of most importance is the resulting disposition of the first arm 16. The proper length, and configuration, of the lug 180 assures that the first arm 16 will be disposed at a proper spacing from the body portion 12 to be molded within cavity 100 such that the finished weight 11 may be received over the lip 15 of the wheel rim 14 and then secured by squeezing the arm 16 toward the body portion 12 of the weight 11 lockingly to embrace the wheel rim 14 therebetween with only mimimal deformation of the clip 18.

The aforesaid rotation of the clip 18, when the angle between the first and second arms 16 and 19 is proper, also effects the desired orientation of the second arm 19 within the cavity 100 of the previously closed mold sections 108 and 109.

Figure 4:
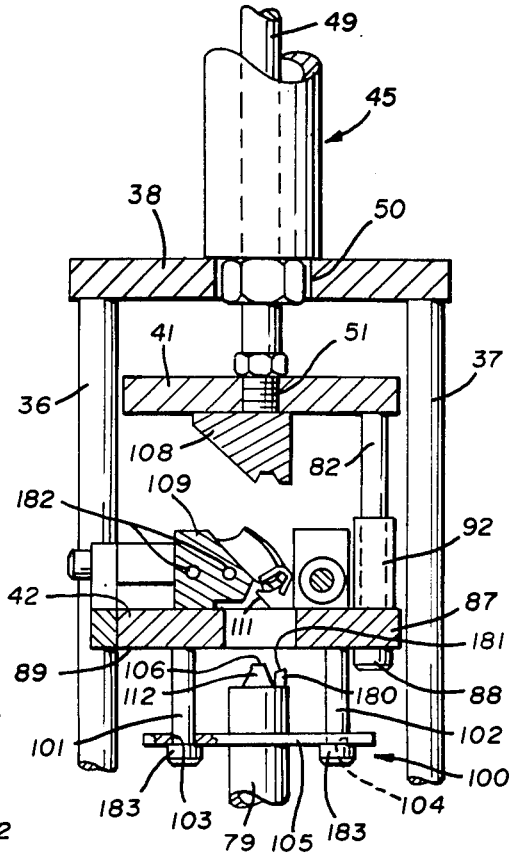
FIG. 4 is a view similar to FIG. 3 but depicting the mold halves in their open position.

To preclude stress concentrations the tip 181 of the lug 180 is preferably truncated in a taper, as depicted most clearly in FIG. 4. By comparing FIGS. 3 and 4 one can observe the orientation of the clip 18 both before and after it is rotated by lug 180. From FIG. 3 one can observe that after the clip 18 has been rotated the arm 19 lies generally along the central plane of the cavity 100, thus assuring that a sufficient thickness of metal will be disposed between the arm 19 and the outer wall of the metal to be molded within the cavity 100.

With the clip 18 now properly positioned, still further extension of the piston rod 49 acts to drive the injection tube 79 axially against the piston 70 to which it is attached. The piston 70 thus acts as a plunger to drive molten metal within the bore 71 past the check valve 78 and upwardly through the exhaust port 76 to exit from the nozzle 106 into the cavity 100 via the sprue hole 111. By thus injecting the molten metal 74 directly into the cavity 100 only minimal pressure is required.

After the molten metal has been injected into the cavity 100 the actuating means 45 is reversed to retract the piston rod. Initially the support plates move simultaneously with, and then away from, the injection tube 79, and the cooling medium circulating through the ducts 182 within the lower mold section 109 accelerates transition of the molten metal within the cavity 100 to its solid, physical state. This separation continues until the feet 183 on the leg members 101 and 102 engage the guide plate 105. Continued retraction of the piston rod 49 overcomes any residual adherence between the molded article and the upper mold section 108 and this permits separation of the support plates 41 and 42 to open the mold sections 108 and 109.

At the time the mold sections begin to open the mounting shaft 123, which was lowered with the second support plate 42, will have realigned with piston rod 160. Hence, when the mold sections are fully separated, the drive means 155 is actuated simultaneously to perform two functions. One, the escapement mechanism releases the next sequential mounting clip 18 from the pawl corner 145 and allows it to slide to the position where it will be held by the pawl stud 150. At the same time an ejection means in the form of a second annular shoulder 184 on the barrel 122 is driven firmly and sharply against the arm 16 on the clip 18 which extends out of the cavity 100. This blow cleanly removes any sprue which might have formed between the cavity 100 and the sprue hole 111 and simultaneously drives the now molded wheel weight 11 out of the lower mold section 109.

As the completed wheel weight 11 passes through the funnel hopper 165 it opens the gate 175 sufficiently to signal completion of the cycle, and the drive means 155 is actuated to retract the piston rod 160. This allows the spring 131 axially to translate the mounting shaft 123 to release the actuating hub 149 on the mounting shaft 123 from the trip stud 148, thus releasing clip 18 held by the pawl stud 150. At the same time the spring 131 assures that the annular stop shoulder 121 is positioned to locate the clip 18 as it slides along the rim 120 of mold section 109. A new cycle then begins.

It should now be fully apparent that an apparatus 10, for molding metallic articles 11, that embodies the concepts of the present invention allows a component, such as the mounting clip 18, to be encapsulated within the molded portion 12 with a predetermined accurate disposition and otherwise accomplishes the objects of the invention.

I claim:

1. Metal molding apparatus comprising:

a stanchion;

a pair of opposed, first and second support plates movable within said stanchion;

first and second mold sections carried, respectively, on said first and second support plates;

activating means supported from said stanchion to move said first support plate carrying said first mold section toward said opposed support plate carrying said second mold section to bring said mold sections into mating juxtaposition, the mating juxtaposition of said mold sections effecting a closure of the molds to form a cavity therebetween, said activating means operable to selectively move said first support plate away from said opposed, second support plate so as to open said mold sections;

an injection tube extending through said second mold section and opening into the cavity formed when said mold sections are closed;

means to selectively pump molten metal through said injection tube and into said cavity having a displacement pump cylinder secured to said stanchion;

a displacement plunger movable axially within said cylinder; a displacement plunger movable axially within said cylinder;

said injection tube being secured to said plunger;

a passage extending axially through said injection tube and communicating, through said plunger, to the pump cylinder;

a reservoir of molten metal available to said cylinder; and, check valve means to permit the free flow of molten metal from said reservoir into said cylinder but to preclude reverse flow thereof.

2. Metal molding apparatus, as set forth in claim 1, wherein said activating means comprises an axially movable rod means secured to said first support plate;

means carried on said stanchion to selectively reciprocate said axially movable rod means.

3. Metal mold apparatus, as set forth in claim 2 wherein said injection tube, extending from said displacement plunger, cooperatively engages said second mold section and wherein the continued axial movement of said rod means in the direction which closes said mold sections effects, subsequently to the closure of said mold sections, axial translation of said injection tube enabling molten metal to be pumped into said mold cavity.

4. Metal molding apparatus, as set forth in claim 1, wherein said activating means comprises a cylinder secured to said stanchion;

a rod means secured to said first support plate and being selectively extensible outwardly of said cylinder and selectively retractable inwardly of said cylinder;

the axially extensible movement of said rod means moving said first support plate toward said second plate to close the mold sections secured thereon;

continued axially extensible movement of said rod driving said second mold section into cooperative engagement with said injection tube;

further continued axially extensible movement of said rod effecting the axial translation of the injection tube enabling molten metal to be pumped into said closed mold cavity.

5. Metal molding apparatus, as set forth in claim 4, wherein said cylinder effects retractable movement of said rod means inwardly of said cylinder to effect a cessation in the pumping action and a sequential opening of said mold sections.

6. Metal molding apparatus, as set forth in claim 1, in which spring means are provided to effect extension of said injection tube axially outwardly with respect to said pump cylinder to replenish the molten metal within said pump cylinder and to prepare said pump means for the next pumping cycle.

7. Metal molding apparatus, as set forth in claim 1, wherein means are provided to directly feed a mounting clip from a hopper into position with respect to said first and second mold sections and locating means are provided properly to position said mounting clip with respect to said mold sections.

8. Metal molding apparatus, as set forth in claim 7, wherein rail means are provided along which said clip means can slide toward said second mold section;

a cavity portion being provided in said second mold section;

a rim circumscribing said cavity portion;

at least a portion of said rim constituting an effective extension of said rail means.

9. Metal molding apparatus, as set forth in claim 8, wherein gate means are operative in conjunction with said rail means to permit only a selective number of clip means to access said second mold section during each molding cycle.

10. Metal molding apparatus, as set forth in claim 8, wherein a stop means is provided to determine the disposition of said mounting clip along the rim of said second mold section.

11. Metal molding apparatus, as set forth in claim 10, wherein means are provided to move said stop means, when desired, to remove a molded article from said cavity.

12. Metal molding apparatus, as set forth in claim 11, wherein a positioning lug is presented from the axially outermost end of said injection tube to engage said metal clip and rotationally orient said mounting clip about the rim of said second mold section.

13. Metal molding apparatus, as set forth in claim 12, wherein means are provided to engage said mounting clip in order to eject the molded article from said mold cavity.

14. Metal molding apparatus, as set forth in claim 13, wherein said stop means and said means to eject are carried on a common shaft means.

15. Metal molding apparatus, as set forth in claim 14, wherein said shaft means is mounted for axial translation and cylinder means are provided axially to translate said shaft locating said stop means and selectively to bring said means to eject into engagement with said mounting clip.

16. Metal molding apparatus comprising:

a stanchion;

a pair of opposed, first and second support plates movable within said stanchion;

first and second mold sections carried, respectively, on said first and second support plates;

activating means supported from said stanchion to move said first support plate carrying said first mold section toward said opposed support plate carrying said second mold section to close said mold sections;

a cavity formed between said closed mold sections;

said activating means operable to selectively open said mold sections;

an injection tube extending through said second mold section and opening into the cavity formed when said mold sections are closed;

means to selectively pump molten metal through said injection tube and into said cavity;

means to feed a mounting clip from a hopper directly into position with respect to said first and second mold sections;

said feed means having rail means terminating in close proximity to said second mold section enabling said clip to slide from said rail means onto said second mold section; and, means to discharge the molded item from said mold sections.

17. Metal molding apparatus comprising:

a stanchion;

a pair of opposed, first and second support plates, both being movable relative to said stanchion;

first and second mold sections carried, respectively, on said first and second support plates;

actuating means supported from said stanchion to move said first support plate carrying said first mold section toward said opposed support plate carrying said second mold section to bring said mold sections in mating juxtaposition forming a cavity therebetween, and thereafter to move said second support plate in spaced parallel disposition with respect to said first support plate, and further operable to selectively move said first support plate away from said opposed, second support plate so as to open said mold section;

an injection tube extending through said second mold section and opening into the cavity formed when said mold sections are closed;

means to selectively pump molten metal through said injection tube and into said cavity;

means to feed a mounting clip from a hopper directly into position with respect to said first and second mold sections;

said feed means having rail means terminating in close proximity to said second mold section enabling said clip to slide from said rail means onto said second mold section; and, means to discharge the molded item from said mold sections.

* * * * *